US007131378B2

(12) United States Patent
Herzbach et al.

(10) Patent No.: US 7,131,378 B2
(45) Date of Patent: Nov. 7, 2006

(54) DEVICE FOR PROCESSING A PRINTING SUBSTRATE

(75) Inventors: Lars Christian Herzbach, Weiterstadt (DE); Joerg Oliver Kain, Weiterstadt (DE); Monika Bluemm, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/730,464

(22) Filed: Dec. 8, 2003

(65) Prior Publication Data

US 2004/0154484 A1 Aug. 12, 2004

(30) Foreign Application Priority Data

Dec. 10, 2002 (DE) ..... 102 57 531

(51) Int. Cl.
*H01F 7/20* (2006.01)

(52) U.S. Cl. ..... 101/378; 101/226; 101/382.1; 101/383; 101/389.1

(58) Field of Classification Search ..... 101/226, 101/375, 378, 382.1, 383, 389.1; 83/331, 83/698.2; 492/8

See application file for complete search history.

(56) References Cited

U.S. PATENT DOCUMENTS

| | | | | |
|---|---|---|---|---|
| 3,618,120 | A * | 11/1971 | Hanbicki | 360/100.1 |
| 3,810,055 | A * | 5/1974 | Wright | 335/285 |
| 5,038,680 | A * | 8/1991 | Bain | 101/401.1 |
| 5,109,741 | A | 5/1992 | Fuchs | |
| 5,230,271 | A | 7/1993 | Hardisty et al. | |
| 5,373,758 | A | 12/1994 | Gerhardt | |
| 5,424,815 | A * | 6/1995 | Koga et al. | 399/282 |
| 2001/0045166 | A1* | 11/2001 | Albus et al. | 101/180 |
| 2003/0019343 | A1 | 1/2003 | Fuchs | |

FOREIGN PATENT DOCUMENTS

| | | |
|---|---|---|
| DE | 3728928 | 3/1989 |
| DE | 3906290 | 8/1990 |
| DE | 4000078 | 7/1991 |
| DE | 29603669 | 5/1996 |
| DE | 19836211 | 2/2000 |
| DE | 19925512 | 12/2000 |
| DE | 10147486 | 6/2002 |
| EP | 0444814 | 9/1991 |
| GB | 2310628 | 9/1997 |
| JP | 06/8402 | 1/1994 |
| JP | 2001253051 | 9/2001 |
| JP | 2003-404218 | 10/2003 |

OTHER PUBLICATIONS

Dictionary.com, definition of "coating".*

* cited by examiner

*Primary Examiner*—Andrew H. Hirshfeld
*Assistant Examiner*—Kevin D. Williams
(74) *Attorney, Agent, or Firm*—Davidson, Davidson & Kappel, LLC

(57) ABSTRACT

A device for processing a printing substrate (22), having at least one processing tool (10), in particular a die plate or a perforating knife, which is accommodated on a rotatable carrier body (14); the carrier body (14) being at least partially provided with a magnetizable coating (16) which, when magnetized, holds the processing tool (10) on the carrier body (14) by the action of magnetic force. The device can be used to advantage in a print finishing machine, a printing press, or in a folding apparatus of a web-fed printing press.

16 Claims, 2 Drawing Sheets

DEVICE FOR PROCESSING A PRINTING SUBSTRATE

Priority to German Patent Application No. 102 57 531.2, filed Dec. 10, 2002 and hereby incorporated by reference herein, is claimed.

BACKGROUND INFORMATION

The present invention relates to a device for processing a printing substrate, having at least one processing tool which is accommodated on a rotatable carrier body.

To process a printing substrate, for example, by punching, cutting, perforating, creasing, or the like, in print finishing machines, printing presses, and folding apparatuses for printing-material processing presses, these machines use processing devices which have one or more processing tools, often in the form of metal sheets having raised portions, and which are accommodated on a rotatable carrier body.

For example, German Patent Application DE 101 47 486 A1, hereby incorporated by reference, describes a die-cutting or cutting device including a rotatable magnetic cylinder (carrier body). The magnetic force effect is due to permanent magnets embedded in grooves. A die plate or cutting plate (processing tool) can be accommodated as a cylinder packing or cylinder covering on the carrier body.

Such carrier bodies for holding in place processing tools can only be produced in a manufacturing process involving a high degree of complexity. First, grooves have to be milled into the carrier body in which the permanent magnets are bonded in place with a resinous material. Subsequently, the surface must be mechanically reworked, i.e. ground, to provide an even surface and shape, which is required for printing technology. To prevent corrosion, the carrier bodies are made of stainless steel. As a consequence, the manufacture involves considerable costs, in particular material costs and processing costs.

As shown, for example, in Japanese Patent Document JP2001-1253051, hereby incorporated by reference herein, it is also known that cylinder packings, such as printing plates, can be provided with a permanent magnetic layer on the side facing a metallic carrier body so that the cylinder packing is held on the carrier body by the action of magnetic force. However, a disadvantage of this is, inter alia, that each individual cylinder packing used must be provided with such a layer, and the magnetic cylinder packings have to be handled with special care in order that the action of magnetic force does not result in unexpected or unwanted effects, such as damage resulting from accelerations of the cylinder packing.

BRIEF SUMMARY OF THE INVENTION

It is an object of the present invention to provide a device for processing a printing substrate, which does not require an expensive carrier body which can be produced only with considerable effort.

According to the present invention, a processing tool is held in place by a magnetic surface layer or coating. A device according to the present invention for processing a printing substrate includes at least one processing tool which is accommodated a rotatable carrier body. The carrier body has a magnetizable coating at least in sections (one or more sections or surface areas) of its supporting surface, preferably over its entire supporting surface. In the magnetized state, the processing tool is held on the carrier body by the action of magnetic force. The magnetizable coating can, in particular, be ferromagnetic. The carrier body can in particular be a rotating body or cylinder, on the lateral surface of which is accommodated the processing tool. The printing substrate can be paper, paperboard, cardboard, an organic polymer (in the form of fabrics, films or workpieces), or the like.

The required magnetic properties (remanence, etc.), i.e., in particular a sufficient magnetic force effect, can already be provided by a magnetizable or magnetic coating having a thickness of 0.001 mm to 10 mm, preferably 0.01 mm to 1 mm. The portative force of the magnetic coating is proportional to the area and proportional to the square of the magnetic flux density produced by the coating (see, for example, H. Kuchling: "Taschenbuch der Physik" (Handbook of Pysics), page 446, Fachbuchverlag Leipzig Publishing House, Leipzig, Germany 1991).

In a preferred embodiment of the present invention, the magnetizable coating is depositable on the carrier body by an electroplating process. By avoiding the different process steps detailed above, in particular, grooving, milling, bonding the permanent magnets in place with epoxy resin, grinding, etc.), for manufacturing a carrier body having a magnetic force effect, the cost of manufacturing a carrier body having a magnetic coating is much lower.

After casting a carrier body, this carrier body is processed to a semi-finished state. The shape is already adjusted to the final requirements or even with slightly better accuracy. Only the diameter of the carrier body is adjusted in such a manner that the desired final diameter is reached after electroplating with the magnetizable material. In case the requirements on the geometry or the tolerances of the geometry, in particular the diameter and roundness, are not achieved by electroplating, the required final state can be adjusted or obtained by reworking, for example, by grinding. It is advantageous to demagnetize the carrier body prior to coating (increased purity of the deposition). The electroplating process allows the magnetizable, in particular, ferromagnetic layer to be deposited on the surface in a very uniform manner so that the magnetic flux density is uniformly distributed over the surface. As an advantageous consequence, a processing tool is uniformly and completely supported at all points. In the event that the carrier body is to be provided with air ducts, which are used, for example, to hold punched printing substrate regions by air suction, these air ducts can be covered during the deposition step to prevent coating or closure of the air ducts. The magnetizable coating can be magnetized by exposing the coated carrier body to a magnetic field. Even without external magnetic field, there remains a remanence, which produces the holding force of the coated carrier body.

In an advantageous embodiment of the device according to the present invention for processing a printing substrate, the coating is a magnetic, corrosion-resistant stainless steel with a nickel content of 80% to 95%. Preferably, the nickel content is 90 to 94%, and the rest is iron and possibly existing tramp or rest elements in a proportion of 6 to 10% so that the proportions of nickel, iron, and possibly existing tramp or rest elements add up to 100%. Such a coating according to the present invention is easy to magnetize and, in addition, is stainless or corrosion-resistant. A particularly advantageous coating is achieved with a nickel content of 91 to 93%, the iron content being 6 to 8%. The proportions of nickel, iron, and possibly existing tramp or rest elements add up to 100%.

In the device according to the present invention, the processing tool can be a die plate, a perforating plate, a cutting knife on a plate, a creasing knife on a plate, or the like. The processing tool can have a plate-shaped or sleeve-shaped design.

For the carrier body, a simple material can be used, such as steel, cast steel, fiber composite, fiber composite material, glass-fiber reinforced or carbon-fiber reinforced plastic. The carrier body can be chosen to be magnetizable. Unlike carrier bodies in which are embedded permanent magnets, the carrier body, in particular, does not have to be stainless or corrosion-resistant because its supporting surface is provided with the coating. In an advantageous embodiment of the device according to the present invention, the carrier body contains a steel, in particular, steel Ck15, or cast steel; in particular, the carrier body can be composed of steel or cast steel. Advantageously, this steel is ferromagnetic so that, like the deposited coating, it has a remaining remanence (magnetic induction) after magnetization. This remanence of the carrier body assists the remanence of the magnetizable or magnetic coating, thus boosting the holding forces for a processing tool to be accommodated.

The device according to the present invention can be used to advantage in a print finishing machine, in particular, in a folder for printed sheets, in a bookbinding machine, or the like. A print finishing machine according to the present invention is characterized by at least one device for processing a printing substrate, such as is described in this specification.

Alternatively, the device according to the present invention can be used in a printing press for example for in-line die cutting. A printing press has at least one printing unit. The printing unit can be, in particular, a direct or indirect planographic printing unit, a wet offset printing unit, a dry offset printing unit, or the like. The printing press can be a sheet-fed or web-fed printing press. Typical printing substrates are paper, paperboard, cardboard, organic polymers (in the form of fabrics, films or workpieces), or the like.

A sheet-fed printing press can have a feeder, a delivery, and possibly also a converting unit (varnishing unit, or the like). The sheet-fed printing press can be straight printing and/or perfecting press. A web-fed printing press can include a reel changer, a dryer, and a folding apparatus. A printing press according to the present invention having at least one printing unit is characterized by at least one device for processing a printing substrate, such as is described in this specification, the device being arranged inside the printing press downstream of the printing unit along the path of the printing substrate through the printing press.

Moreover, the device according to the present invention can be used in a folder of a web-fed printing press, i.e., an apparatus in which sections of the material web are cut from the material web and processed into signtures. A folder according to the present invention of a web-fed printing press is characterized by at least one device for processing a printing substrate, such as is described in this specification.

BRIEF DESCRIPTION OF THE DRAWINGS

Further advantages as well as expedient embodiments and refinements of the present invention will be depicted by way of the following Figures and the descriptions thereof. Specifically.

DETAILED DESCRIPTION

Figure 1:
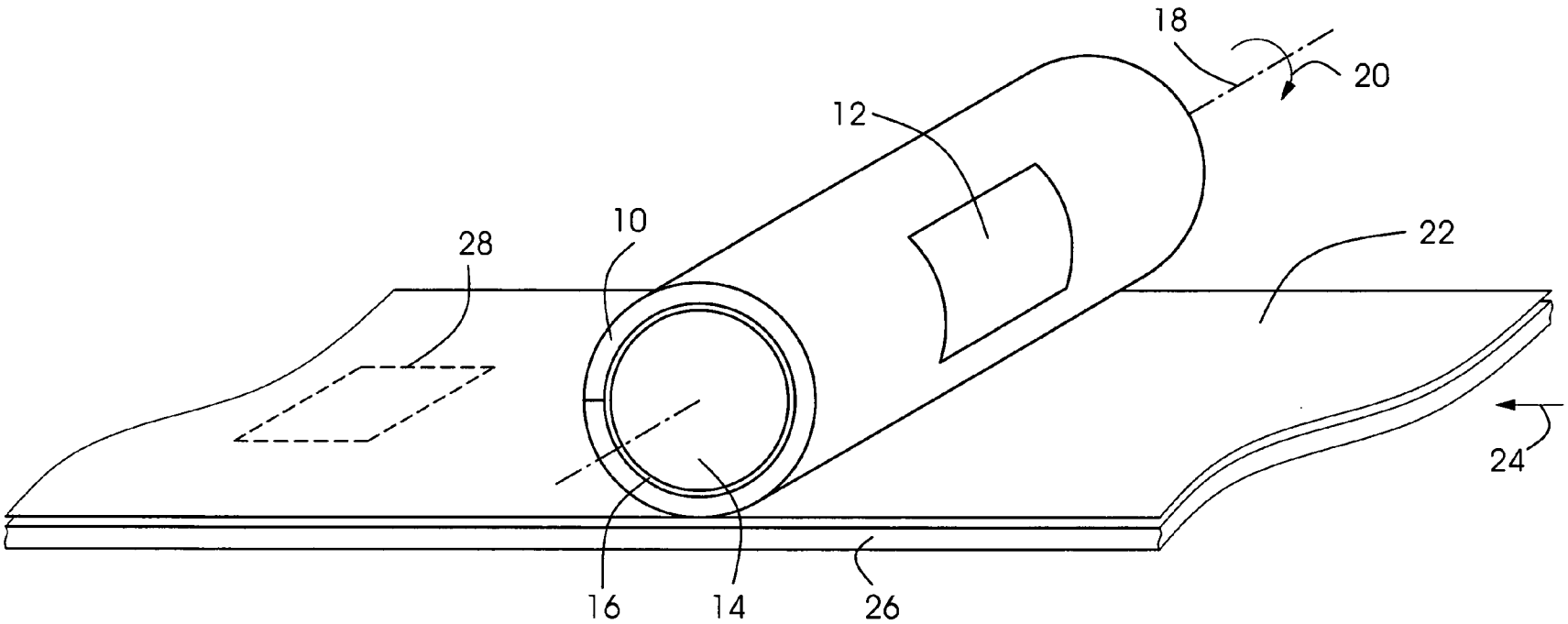
FIG. 1 shows a specific embodiment of a device according to the present invention for processing a printing substrate.

FIG. 1 shows a specific embodiment of a device according to the present invention for processing a printing substrate. A processing tool 10 in the form of a metal sheet having a raised portion 12, here a die plate, is accommodated on a cylindrical carrier body 14. According to the present invention, cylindrical carrier body 14 has a magnetizable layer 16 which is magnetized so that processing tool 10 is accommodated and held on carrier body 14 by the action of magnetic force. Carrier body 14 (not shown in detail here) is supported in such a manner that carrier body 14 can rotate about its axis of rotation 18. The rotary motion is indicated by arrow 20. A printing substrate 22, in this embodiment in web form, passes through the processing device in trasport direction 24 on a transport device 26. Printing substrate 22 is processed in the nip between carrier body 14 and transport device 26. A processed region 28 can be seen downstream of the processing device.

Figure 2:
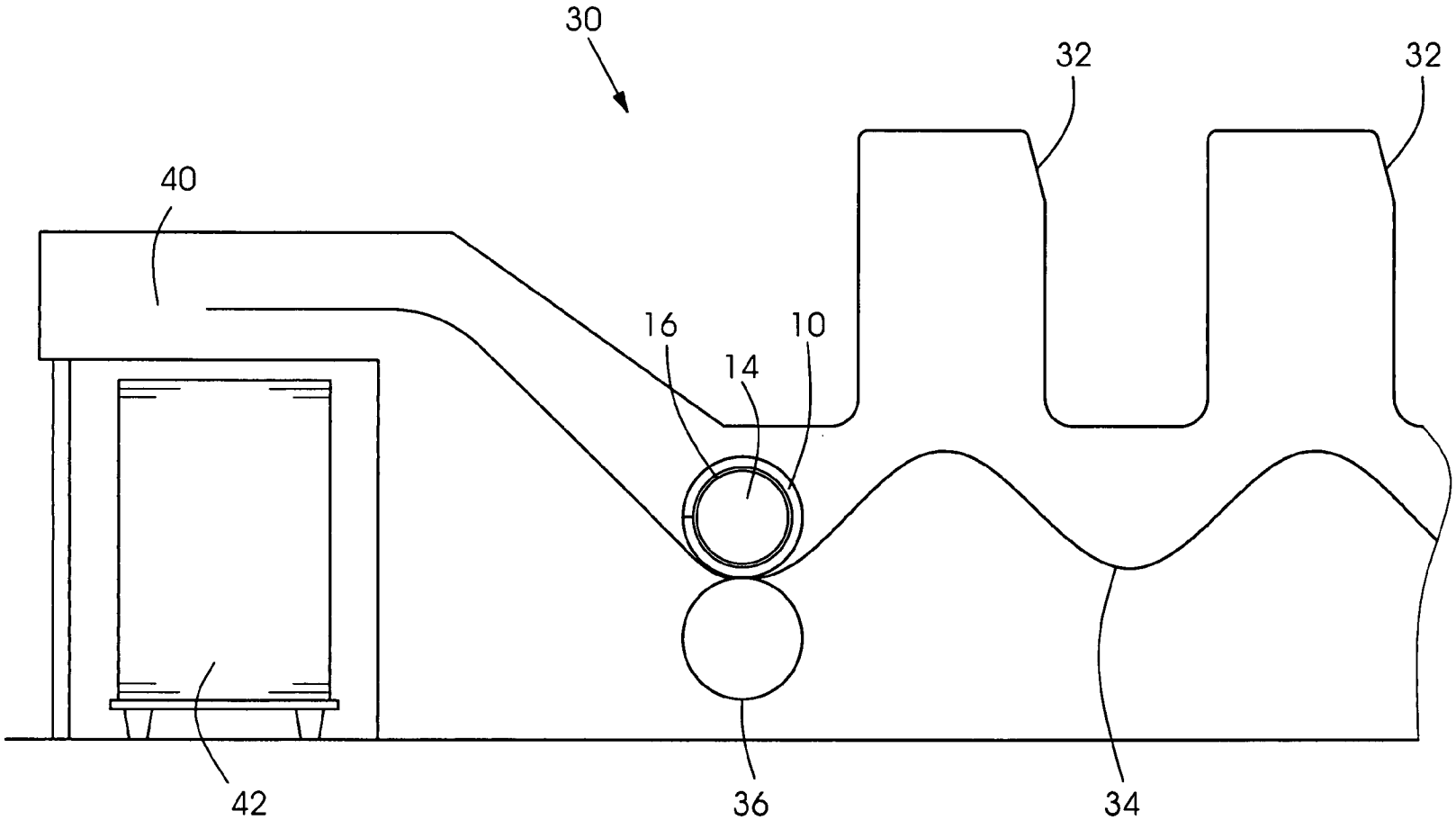
FIG. 2 shows a schematic representation of a printing press having a device according to the present invention.

FIG. 2 is a schematic representation of a printing press having a device according to the present invention for processing a printing substrate. In this illustration, printing press 30 is embodied as a sheet-fed press. There are shown printing units 32, through which sheets are transported from cylinder to cylinder and printed along a path 34 before the sheets reach a delivery unit 40, in which they are deposited on a printing substrate pile 42. A device according to the present invention for processing the printing substrate is arranged downstream of a printing unit 32. Path 34 of the printing substrate runs between a carrier body 14, which has a magnetizable coating 16 and on which is accommodated a processing tool 10, and an impression cylinder 36.

The device according to the present invention can also be used in an analogous manner in a print finishing machine or in a folder of a web-fed printing press.

LIST OF REFERENCE NUMERALS

10 processing tool
12 raised portion
14 carrier body
16 magnetizable coating
18 axis of rotation
20 rotary motion
22 printing substrate
24 transport direction
26 transport device
28 processed region
30 printing press
32 printing unit
34 path of the printing substrate through the printing press
36 impression cylinder
38 processing nip
40 delivery unit
42 pile of printed sheets

What is claimed is:

1. A device for processing a printing substrate comprising:

a rotatable carrier body; and at least one processing tool accommodated on the rotatable carrier body, the at least one processing tool having a working surface for effecting a physical change in the printing substrate, the carrier body having, at least partially, a magnetizable coating, the magnetizable coating when magnetized holding the processing tool on the carrier body by magnetic force, wherein the magnetizable coating is an electroplating.

2. The device for processing a printing substrate as recited in claim 1 wherein the coating is a magnetic, corrosion-resistant stainless steel with a nickel content of 80% to 95%.

3. The device for processing a printing substrate as recited in claim 2 wherein the nickel content is 91 to 93%, and the rest is iron.

4. The device for processing a printing substrate as recited in claim 1 wherein the processing tool is a die plate or a perforating plate.

5. The device for processing a printing substrate as recited in claim 1 wherein the carrier body contains steel or a fiber composite.

6. The device for processing a printing substrate as recited in claim 5 wherein the carrier body contains cast steel.

7. The device for processing a printing substrate as recited in claim 1 wherein the carrier body is magnetizable.

8. The device for processing a printing substrate as recited in claim 1 wherein the carrier body is a rotating body or cylinder, the processing tool being accommodated on a lateral surface of the rotating body or cylinder.

9. A print finishing machine, comprising at least one device for processing a printing substrate as recited in claim 1.

10. A printing press comprising at least one printing unit and a device for processing a printing substrate as recited in claim 1 arranged downstream of the printing unit.

11. A folder of a web-fed printing press comprising at least one device for processing a printing substrate as recited in claim 1.

12. The device as recited in claim 1 wherein the thickness of the coating is between 0.001 and 10 mm.

13. The device as recited in claim 12 wherein the thickness of the coating is 0.01 mm to 1 mm.

14. The device as recited in claim 1 wherein the rotatable carrier body has an outer surface, the magnetizable coating being distributed in a uniform manner over the outer surface.

15. A method for manufacturing the device as recited in claim 1 comprising the step of coating the rotatable carrier body with the magnetizable coating.

16. The method as recited in claim 15 wherein the coating step includes electroplating.

* * * * *

UNITED STATES PATENT AND TRADEMARK OFFICE

CERTIFICATE OF CORRECTION

PATENT NO. : 7,131,378 B2
APPLICATION NO. : 10/730464
DATED : November 7, 2006
INVENTOR(S) : Lars Christian Herzbach, Joerg Oliver Kain and Monika Bluemm It is certified that error appears in the above-identified patent and that said Letters Patent is hereby corrected as shown below:

On the title page, item
(56) References cited
under the heading
FOREIGN PATENT DOCUMENTS
cancel the following reference:
"DE 19925512 12/2000" and insert the following reference:
--DE 19925612 12/2000--.

Column 1, line 60, cancel the text "surface layer or".

Column 2, line 23, "etc.)" should be changed to --etc.--.

Column 4, line 8, "layer" should be changed to --coating --.

Signed and Sealed this

Twenty-seventh Day of March, 2007

JON W. DUDAS
*Director of the United States Patent and Trademark Office*